US006734423B2

(12) United States Patent
Bryden

(10) Patent No.: US 6,734,423 B2
(45) Date of Patent: May 11, 2004

(54) PULSED LASER SAMPLING FOR MASS SPECTROMETER SYSTEM

(75) Inventor: Wayne A. Bryden, Ellicott City, MD (US)

(73) Assignee: The Johns Hopkins University, Baltimore, MD (US)

( * ) Notice: Subject to any disclaimer, the term of this patent is extended or adjusted under 35 U.S.C. 154(b) by 0 days.

(21) Appl. No.: 10/030,396

(22) PCT Filed: May 23, 2001

(86) PCT No.: PCT/US01/16694

§ 371 (c)(1),
(2), (4) Date: Jan. 8, 2002

(87) PCT Pub. No.: WO01/93305

PCT Pub. Date: Dec. 6, 2001

(65) Prior Publication Data

US 2003/0006369 A1 Jan. 9, 2003

Related U.S. Application Data

(60) Provisional application No. 60/208,089, filed on May 31, 2000.

(51) Int. Cl.[7] ..... H01J 49/10

(52) U.S. Cl. ..... 250/288; 250/282; 250/423 P; 250/286; 356/318

(58) Field of Search ..... 250/288, 282, 250/423 P, 286; 356/318

(56) References Cited

U.S. PATENT DOCUMENTS

| | | | | |
|---|---|---|---|---|
| 4,209,697 A | | 6/1980 | Renner et al. | |
| 4,740,692 A | | 4/1988 | Yamamoto et al. | |
| 4,855,594 A | | 8/1989 | Kimock et al. | |
| 4,889,987 A | | 12/1989 | Gruen et al. | |
| 5,210,412 A | | 5/1993 | Levis et al. | |
| 5,308,979 A | | 5/1994 | Villa-Aleman | |
| 5,580,733 A | | 12/1996 | Levis et al. | |
| 5,663,561 A | * | 9/1997 | Franzen et al. | 250/282 |
| 5,728,584 A | * | 3/1998 | Sausa et al. | 250/282 |
| 6,281,493 B1 | * | 8/2001 | Vestal et al. | 250/287 |

FOREIGN PATENT DOCUMENTS

| | | |
|---|---|---|
| DE | 222 730 A | 5/1985 |
| EP | 0 860 859 A1 | 8/1998 |
| FR | 2 797 956 A | 3/2001 |

OTHER PUBLICATIONS

K.P.Aicher et al.: "multiphoton Ionization of molecules: a comparison between femtosecond and nanosecond laser pulse ionization efficiency" Journal American Society for Mass Spectrometry, vol. 6, 1995, pp. 1059–1068, XP002200284, p. 1060; figure 2.

Patent Abstracts of Japan, vol. 2000, No. 03, Mar. 30, 2000 & JP 11 352105 A (NKK Corp), Dec. 24, 1999 abstract.

* cited by examiner

*Primary Examiner*—John R. Lee
*Assistant Examiner*—Zia R. Hashmi
(74) *Attorney, Agent, or Firm*—Francis A. Cooch

(57) ABSTRACT

A mass spectrometer system comprising a laser and a mass spectrometer. The mass spectrometer has a vacuum interface that provides entrance of a gaseous sample into an extraction region of the mass spectrometer. The laser is positioned to provide laser light incident on a sample non-gaseous substance positioned adjacent the vacuum interface. The laser light provides vaporization of the sample, which provides a high concentration of gaseous molecules from the sample substance at the vacuum interface.

10 Claims, 3 Drawing Sheets

PULSED LASER SAMPLING FOR MASS SPECTROMETER SYSTEM

CROSS-REFERENCE TO RELATED APPLICATIONS

This application claims priority to U.S. Provisional Application 60/208,089, filed May 31, 2000, entitled "Pulsed Infrared Laser Sampling Methodology for Time-of-Flight Mass Spectrometer Detection of Particulate Contraband Materials" of Wayne A. Bryden. The contents of the aforesaid U.S. Provisional Application No. 60/208,089 are hereby incorporated by reference.

BACKGROUND OF THE INVENTION

1. Field of the Invention

The invention relates to mass spectrometry, mass spectrometers and applications thereof.

2. Description of the Related Art

Mass spectrometers provide a fundamental tool of experimental chemistry and have proven useful and reliable in identification of chemical and biological samples. Mass spectrometry is a technique used to determine the masses of molecules and specific fragmentation products formed following vaporization and ionization. Detailed analysis of the mass distribution of the molecule and its fragments leads to molecular identification. The combination of specific molecular identification and extreme sensitivity makes molecular spectroscopy one of the most powerful analytical tools available.

However, the typical mass spectrometer is confined to the laboratory or other fixed sites due to its relatively large size and weight, as well as its high power and cooling requirements. Thus, mass spectrometer technology has not been used as a field portable detection system. Other impediments to field use include large storage reservoirs of samples that are typically required for reliable identification, whereas field samples are often much smaller and detection of such small samples is often essential (for example, in the case of detection of a chemical or biological agent that is lethal at small doses).

Thus, there is typically an abundant sample available for analysis in mass spectrometers located in a laboratory or in a commercial setting. Thus, a highly resolved spectrum may be achieved by repeated ionization and detection of the analyte. By contrast, in the field, only a small and diffuse sample maybe available for collection from the environment. In addition, samples collected in the field (for example, a soil sample that only contains trace amounts of an explosive) may not be adequate for identification of a chemical or biological agent contained therein even if transported to a laboratory grade mass spectrometer.

A significant related problem arises in chemical vapor detection of certain substances using mass spectroscopy. For example, chemical vapor detection of certain important substances that require detection, such as drugs and explosive compounds, is hindered by their extremely low vapor pressures. For example, the equilibrium vapor pressure of trinitrotoluene (TNT) is $10^{-9}$ atm and RDX it is $10^{-9}$ atm. For these types of vapor concentrations, it is difficult for even the highly sensitive detection performed by a mass spectrometer to accurately measure concentrations.

For these compounds, a different detection technique relies on the principle that vapor pressure of a substance increases exponentially with increasing temperature. Hence, for certain applications such as batch sampling of suspected packages, the detection community has implemented a technology based on collection of particulate matter from contaminated surfaces by wiping or vacuuming onto a filter media. The sample is then heated to a point where it develops sufficient vapor pressure to enable vapor phase detection. This approach, however, is extremely slow, inefficient and, considering the bulk thermal treatment of the sample media, very power hungry.

SUMMARY OF THE INVENTION

Among other things, it is thus an object of the invention to provide a system and method that provides an efficient collection of particulate samples for analysis by a mass spectrometer. It is a further objective of the invention to provide a system and method that efficiently vaporizes a substance of interest (i.e., a particular chemical or biological agent) that is then provided in a highly concentrated amount to an extraction stage of a mass spectrometer. Finally, it is an objective to implement both of the aforementioned objectives in a field portable mass spectrometer.

In accordance with these objectives, the invention provides a mass spectrometer system comprising a laser and a mass spectrometer. The mass spectrometer has a vacuum interface that provides entrance of a gaseous sample into an extraction region of the mass spectrometer. The laser is positioned to provide laser light incident on a sample nongaseous substance positioned adjacent the vacuum interface. The laser light provides vaporization of the sample, which provides a high concentration of gaseous molecules from the sample substance at the vacuum interface.

The invention also provides a method of analyzing a non-gaseous sample for a compound of interest. The method includes generating laser light having at least one parameter adjusted to provide enhanced vaporization of the compound of interest from the sample. The laser light is directed so that it is incident on the sample for at least one time interval, thereby vaporizing at least part of the sample. A collection of at least a portion of the vapor is synchronized with the at least one time interval. A chemical vapor analysis of the portion of the vapor collected is performed, the chemical vapor analysis including determining whether the substance of interest is present in the sample.

DESCRIPTION OF THE PREFERRED EMBODIMENTS

Figure 1:
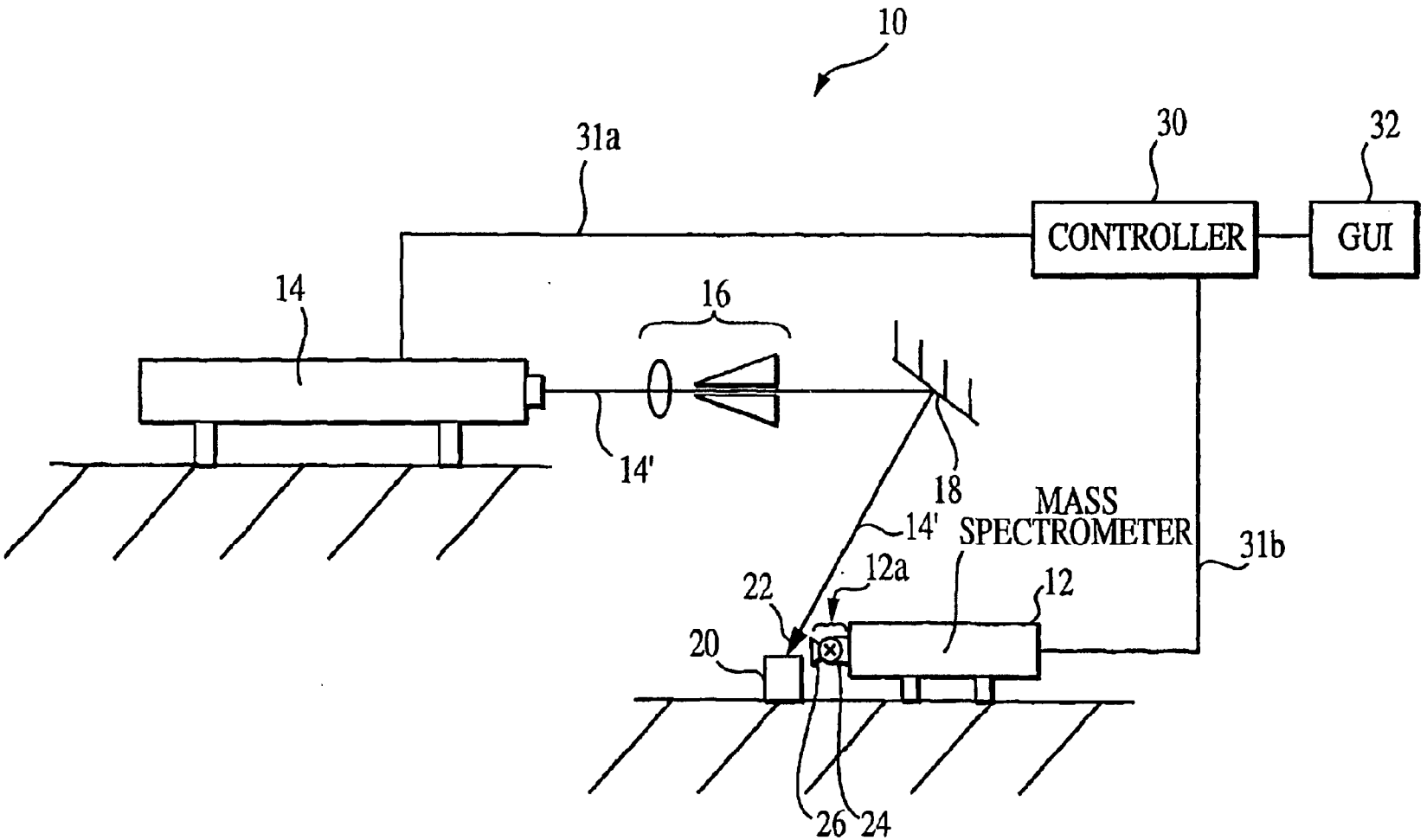
FIG. 1 is a schematic representation of a mass spectrometer system in accordance with the present invention.

Referring to FIG. 1, the principle components of an embodiment of the mass spectrometry system 10 of the present invention are shown. The mass spectrometer system of the embodiment of FIG. 1 is a stationary system, for example, one that generally remains in a fixed location, such as a laboratory, commercial operation, airport security office, etc. The mass spectrometer 12 of the system may be any type of mass spectrometer, which are well known in the art. For example, mass spectrometer 12 may be a time-of-flight mass spectrometer.

Laser 14 shown in FIG. 1 may be a pulsed infrared (IR) laser. Laser light 14' emitted from laser 14 is focused via focusing optics 16 (which may comprise lenses and collimators) and reflected by reflecting surface 18 (such as a mirror) onto a top surface of table 20. A continuous wave laser with an associated shutter system may be substituted for the pulsed laser. (For convenience, the specification will principally refer to a "pulsed laser", which will be understood to mean other configurations, including the continuous wave laser with a shutter system.) A sample 22 is positioned on the surface of table 20 at the surface area where the laser light 14' is incident. Thus, as shown, when laser light 14' is emitted from laser 14, it is incident on sample 22.

As shown, mass spectrometer 12 is adjacent to table 20. A pulsed valve 24 and associated gas intake 26 are part of an extension portion 12*a* of mass spectrometer 12. When pulsed valve 24 is pulsed open, the vacuum of the mass spectrometer draws air or other gas into the mass spectrometer through the gas intake 26. The air intake 26 is, for example, a conical funnel. The gas intake 26 structure is optional; the intake portion of the pulsed valve 24 itself may provide the gas intake.

A controller 30 (which may be any digital control device, including a processor, microprocessor, PC, computer, microcomputer, etc.) provides control signals to laser 14 and mass spectrometer 12 via signal conduits (for example, electrical wires) 31*a*, 31*b*. The signal sent from controller 30 to laser 14 initiates a pulse of laser light 14' from laser 14 and, as described above, is incident on the sample 22. At or about the same time the signal is sent from the controller 30 to laser 14, a control signal is sent from controller 30 to mass spectrometer 12 to open pulsed valve 24.

The pulse of laser light 14' arriving at the sample 22 serves to vaporize a portion of the sample 22, which creates a vapor plume at the gas intake 26. As noted, the pulsed valve 24 is briefly pulsed open at about the same time by the signal sent from the controller 30 to the mass spectrometer 12. When open, the vacuum of the mass spectrometer 12 serves to draw vapor (molecules) from the sample 22 into the gas intake 16, through the valve, and into an adjacent extraction region of the mass spectrometer 12. For vapor matter that is not ionized by laser light 14' prior to entering the mass spectrometer 12, the ionizing mechanism of the extraction region of the mass spectrometer 12 provides ionization, followed by acceleration due to a voltage applied across a portion of the extraction region. If some matter is previously ionized by the laser light 14', it will be accelerated by the potential difference even if there is no further ionization in the mass spectrometer 12.

The controller 30 provides user input, shown in FIG. 1 as GUI 32. Other input mechanisms may be substituted for the GUI. The GUI 32 may allow the user to initiate pulsing of the laser 14 and the corresponding pulsing of the pulsed valve 24 by the controller 30. It may also provide for multiple pulsings such that multiple vapor samples are created and collected for analysis by the mass spectrometer 12. It may also provide multiple pulsings of the laser 14 to ensure vaporization of the sample 22, which is then collected by a single pulsing of the pulsed valve 24. In addition, the GUI may provide a menu to a user of chemicals or biological compounds. The user may select a particular chemical and or biological compound suspected of being present in the sample 22. Controller 30 may have an associated database that correlates the selected compound with associated lasing parameters. The lasing parameters may comprise, for example, the optimum wavelength, power, pulse frequency and/or pulse-width of laser light to provide a degree of specificity for the compound of interest.

For example, the stored parameter regarding optimum power for a compound may be the threshold power that is just sufficient to vaporize the compound of interest. Such power, when directed at a sample, will thus vaporize the compound of interest while other less volatile compounds will remain in the solid phase and not contribute to a background reading in the mass spectral analysis. The optimum wavelength stored for a compound, for example, may be a wavelength near a common vibrational transition of the compound. Such a wavelength would provide a resonant heating effect of the compound that further enhances the signal to environmental noise ratio in the mass spectral analysis.

Such optimizing parameters for the database of compounds associated with the controller 30 may be determined through empirical testing. For example, samples of a known compound may be placed in the system 10 shown in FIG. 1, and a lasing parameter may be varied and the mass spectral readings may be recorded and compared. The optimum setting of the lasing parameter may be determined by comparing the mass spectral readings. Other lasing parameters and other known compounds may be analyzed in like manner, thus creating the database of optimum lasing parameters for a range of compounds.

For example, experimental measurements for the compound 1,3,5-Trinitro-1,3,5-triazacyclohexane (RDX), indicate that for a $CO_2$ pulsed laser, a set of preferred vaporizing parameters comprises a wavelength of 10.6 mm, a 100 ns pulse width and a pulse energy of 10 mJ/pulse.

Controller 30 transmits the appropriate control signals to laser 14 so that the parameters of the laser light are in accordance with the associated wavelengths stored in the database which are associated with the compound of interest selected by the user. Thus, for example, if there is an associated optimum power associated with the selected compound, then the controller 30 sends a signal to the laser 14 so that laser light is emitted at the optimum power. As noted above, such a power setting serves to vaporize the compound of interest if it is present in sample 22, while other less volatile compounds that might be present in sample 22 will remain in the solid phase. Thus, the vapor drawn into mass spectrometer 22 via the pulsed valve 24 will have a large heart cut of the compound of interest (if present), since the less volatile compounds that are not of interest will not be vaporized and will thus not contribute to a background reading in the mass spectral analysis.

As noted, pulsing of pulsed valve 24 and pulsing of the laser 14 occurs at or about the same time, as initiated by control signals from controller 30. Because the laser light 14' is effectively transmitted to the sample 22 instantaneously, thermalization of the sample 22 occurs simultaneously with the pulsed opening of the pulsed valve 24. As also noted, the vapor drawn into the mass spectrometer through the pulsed valve 24 thus has a large heart cut of the sample vapor. Alternatively, the controller 30 may slightly delay pulsing of the pulsed valve 24, so that it occurs slightly after pulsing of the laser 14. The laser pulse may vaporize certain substances present in the sample 22, for example, water, before the compound of interest. Thus, the leading edge of the vapor plume created at the sample 22 may be water (or other) vapor, followed by the vapor from the substance of interest. By slightly delaying opening of the pulsed valve 24, the leading edge of the plume will have passed, and the vapor in the vicinity of the valve 24 will have its highest concentration of the substance of interest. Thus, a better heart cut of the substance of interest will enter the mass spectrometer 12. A delay on the order of 0.1 ms for a sample 22 positioned approximately 1 cm from the pulsed valve 24 provides the requisite delay.

As noted, the vapor particles drawn into the mass spectrometer 12 via the pulsed valve 24 enters the extraction region of the mass spectrometer, where they are ionized and accelerated. Ionization may take place in any number of conventional ways, such as using an electron beam or an ionizing laser. Acceleration is generally provided by a potential difference between two plates or grids, one at a high voltage and a second at ground. The corresponding mass spectrum output by the mass spectrometer 12 is analyzed to determine if the compound of interest is present. The mass spectrum may be analyzed in a traditional manner, for example, by an expert analyst viewing an oscilloscope (not shown) connected to the detector (not shown) of the mass spectrometer 12. Alternatively, the controller 30 may contain software that automatically identifies the threat by receiving the mass spectral data from the detector of mass spectrometer 12. Certain identification processing by a controller associated with a mass spectrometer is described in U.S. patent application Ser. No. 60/207,907, filed May 30, 2000 entitled "Mass Spectrometer Threat Identification System" for Hayek, et al., the contents of which are hereby incorporated by reference.

For a mass spectrometer system 10 that has an abundant power supply, such as one in a fixed location as shown in FIG. 1 (for example, in an airport, lab or other setting), the pulsed valve 24 may be replaced with a small opening that comprises a small, controlled leak in the vacuum portion of the mass spectrometer 24 adjacent the extraction region. The leak may be, for example, $1\times10^4$ Torr liters/sec [vol/time]. For such a leak, the vacuum pumps of typical laboratory and commercial mass spectrometers may readily maintain the required vacuum in the system. In this configuration the mass spectrometer 12 will be continually pulling in air and other particulate matter from the environment. Thus, the controller 30 may be programmed to switch the output from the detector of the mass spectrometer 12 on when there is laser pulsing of the sample 22 and to switch the detector output off when there is no pulsing. The mass spectral output of the detector will thus correspond to those times when laser light 14' is incident on the sample 22, and the attendant vapor from the sample 22 is drawn into the mass spectrometer 12.

A system that includes a mass spectrometer having a controlled leak may comprise, for example, an ion mobility spectrometer (IMS), which is commonly used for detection of explosives and drugs. In particular, a Photo-Chem 110 with a Model SF-12 air sampler (available from the Idaho National Engineering and Environmental Laboratory) and a $CO_2$ pulsed laser provide good results. In the trials, the pulsed valve used was the Iota One valve (Model Number 99-46-900) from General Valve Corporation driven by the Iota One valve controller.

Figure 2:
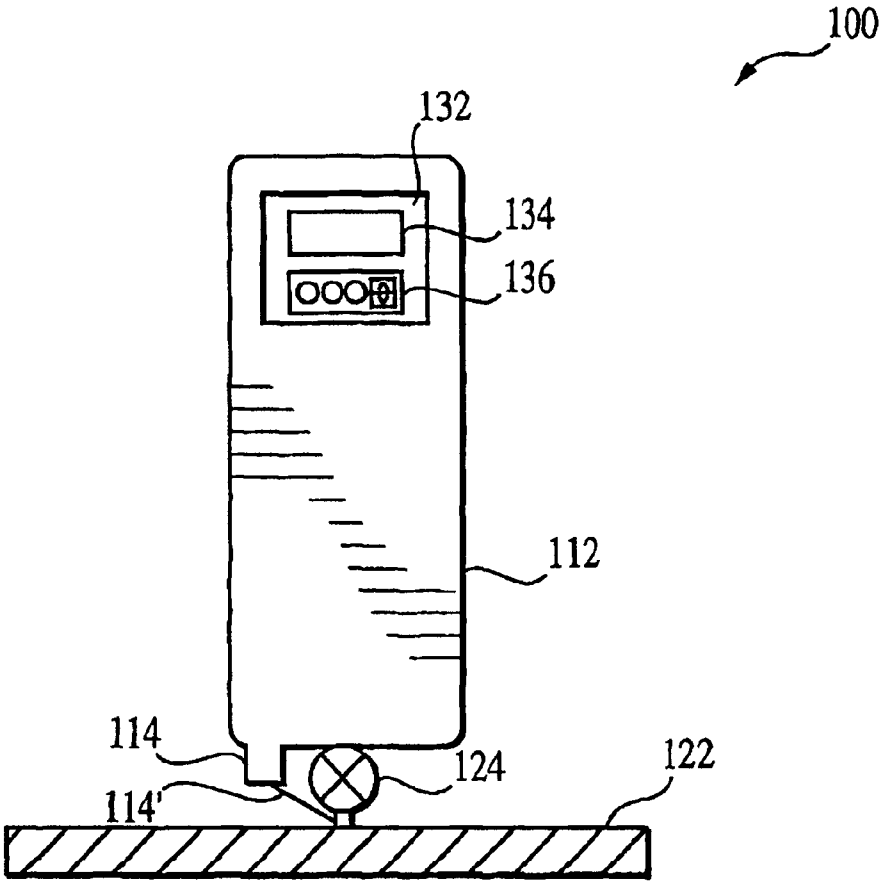
FIG. 2 is an alternative embodiment of a mass spectrometer system in accordance with the present invention.

FIG. 2 depicts a second embodiment of the invention, wherein the mass spectrometer system 100 is portable. The mass spectrometer system 100 has many analogous components to that depicted in FIG. 1 and described above, and generally operates using the same principles. Thus, housing 112 houses a portable mass spectrometer, which may be, for example, a TOF mass spectrometer. (The principle components of an embodiment of a TOF mass spectrometer included within housing 112 is described further below with respect to FIG. 3.) Housing includes a user interface 132, comprising a display 134 and keypad 136 for user input. The display 134 and keypad 136 of the interface 132 interfaces with a processor (not shown in FIG. 2) located within housing 112, which generally controls the operation of the mass spectrometer system 100.

At an end of the housing 112 is a pulsed valve 124 and a pulsed UV laser 114. When pulsed open, the pulsed valve 124 provides an entrance for a sample compound from the environment outside of the housing 112 and into the vacuum of the mass spectrometer contained within the housing. Pulsed valve 124 is located adjacent the extraction region (i.e., the ionizing and acceleration region) of the mass spectrometer. Thus, when a sample compound enters the mass spectrometer via pulsed valve 124, it is ionized, accelerated and provides a mass spectral output in accordance with the operation of the particular mass spectrometer used.

In general, the system 100 may be held directly adjacent a surface 122 that is suspected of including particles of a compound of interest. Pulsed laser 114 (which may be, for example, a $CO_2$ pulsed UV laser) emits one or more laser pulses 114' that are directed immediately in front of the opening of the pulsed valve 124 which, as shown, is incident on surface 122. As in the first embodiment, the parameters of laser pulses 114' are optimized for the compound of interested, thus heating and providing a vapor plume that will include a high concentration of molecules of the compound of interest (if present) adjacent the pulsed valve 124. The pulsed valve 124 is opened simultaneously with the pulsing of the laser 114 (or momentarily thereafter, as described above for the first embodiment), thus drawing the highly concentrated vapor into the vacuum of the mass spectrometer.

The user selects a substance of interest through the interface 132, for example, by scrolling through a menu of compounds on the display 134 using the keypad 136, and then selecting a compound of interest using the keypad 136. The selection is transmitted to the processor, which consults an associated database that comprises optimized lasing parameters for the substances contained therein. The processor uses the optimized parameters of the selected substance of interest to adjust the parameters of laser 114, analogous to the manner described above for the first embodiment. Collection of the sample (i.e., pulsing of the laser 114 and valve 124) may be initiated through keypad 136.

As described above, the laser pulse 114' will vaporize compounds located on surface 122 and, if the compound of interest is present on surface, then a relatively high concentration of the compound will be drawn into the mass spectrometer with the corresponding pulsing of pulsed valve 124. As noted, the particles are accelerated by mass spectrometer and the detector of the mass spectrometer provides a mass spectral output for the particles. The mass spectral output may be analyzed by software in the processor, which may also provide an output to the user via display 134 of whether the compound of interest is present. The detection of other compounds may also be displayed.

The processor may include software that analyzes the compound in accordance with the aforementioned U.S. patent application Ser. No. 60/207,907. Alternatively, the mass spectral output itself may be displayed to the user, who may be a mass spectral analyst trained to determine the presence or absence of compounds based on spectral lines.

In addition, portions or the majority of the processing provided for the system 100 may be provided by a separate processing device that interfaces (via a wire, air, fiber optic or other interface) with the system 100 as shown. For example, a PC having an input/output cable may interface with a cable port on the housing 112. The PC may provide a GUI wherein the user selects the compound of interest and the associated optimum lasing parameters are selected from a database in the PC and attendant control signals are sent to the laser 114 to adjust the laser to the optimum parameters. Once a mass spectrum is generated by the mass spectrometer, it may be transmitted via the cable to the PC, where it is processed to determine if the compound of interest is present.

The above-described PC may provide all processing control of the mass spectrometer system 100, or portions thereof. For example, once the optimizing parameters are transmitted to the mass spectrometer system 100 and the parameters are adjusted to the compound of interest, the system 100 may be disengaged, transported to a remote site, where the system 100 is used to collect compounds from various surfaces and generate the corresponding mass spectra. (In this case, the mass spectrometer system 100 would have to have a limited amount of processing and storage, to generate and store the mass spectra. It would also have to store the processing required to pulse the laser 114 and valve 124 when activated by the user (for example, via a switch). It may also have to store and process one or more of the downloaded optimizing parameters themselves, such as the pulse-width of the laser for the compound of interest.) Once the samples are collected and the mass spectra are generated, the system 100 may be re-engaged with the PC, wherein the mass spectra are downloaded and processed to determine whether the compound of interest is present.

Figure 3A:
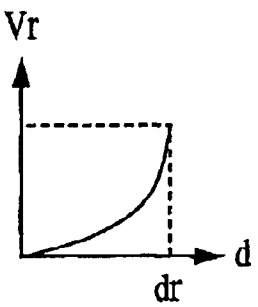
FIG. 3*a* is a graph of voltage versus distance for a component shown in FIG. 3.
Figure 3:
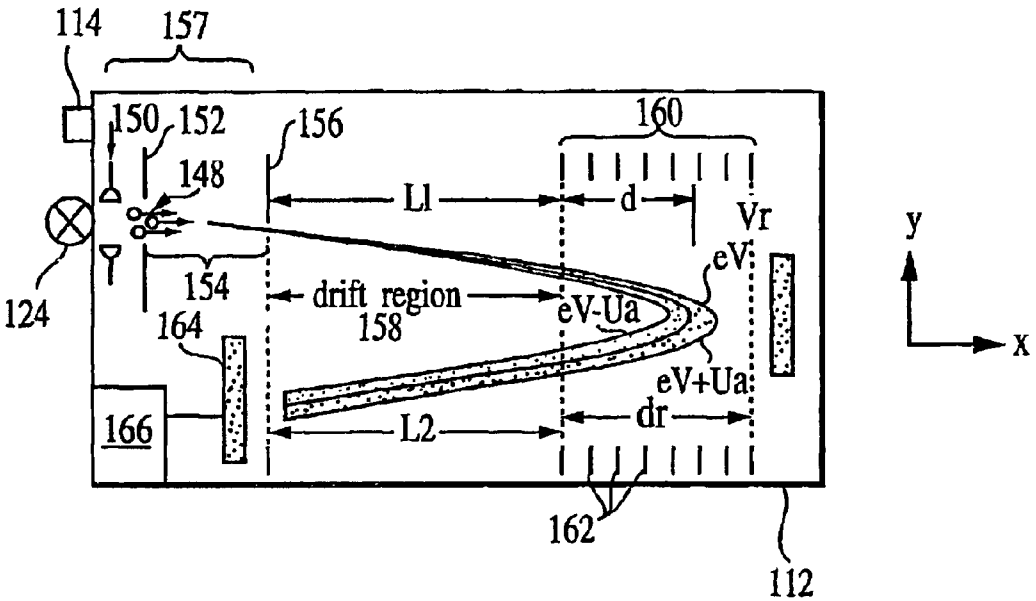
FIG. 3 is a representational cross-section of components of the mass spectrometer system as shown in FIG. 2.

FIG. 3 is a representative depiction of the interior of housing 112 for a particular type of mass spectrometer, namely a nonlinear reflectron time-of-flight (TOF) mass spectrometer. Various components attendant to the mass spectrometer that are well-known, such as the vacuum pumps, chambers, valves, etc., are omitted for convenience. As shown in FIG. 3, molecules 148 in vapor form from a sample enter the vacuum chamber via pulsed valve 124 as described above. The molecules 148 are bombarded by electrons of an ionizing electron beam, represented by component 150, thus transforming the molecules into ionized particles (which are also referred to with the same reference number 148). The ionized particles 148 pass through an opening of high voltage electrode 152 (having voltage V) and into an acceleration region 154 defined by high voltage electrode 152 and ground electrode 156. (The extraction region 157 shown is thus comprised of the ionization region of the electron beam 150 and the acceleration region 154.) The particles 150 are thus accelerated between electrodes 152 and 156 and pass through an opening in ground electrode 156 with energy approximately equal to eV (presuming the particles have a single ionized charge).

The ionized particles travel through a drift region 158 and into a reflector or reflectron region 160 at the end of the drift region 158, which applies a voltage that increases according to the equation of a circle with distance that the ion penetrates the reflectron region 160. The voltage applied by the reflectron 160 is as shown in FIG. 2*a*. The reflector or reflectron generally comprises a series of equally spaced conducting rings 162 that form a retarding/reflecting field in which the ions penetrate, slow down gradually, and reverse direction, thereby reflecting the ion's trajectory back along the incoming path, as shown in FIG. 2. (The distance traveled by the ions in the Y direction as shown in FIG. 2 are exaggerated for convenience.)

Ions of a given mass pass into the reflector and are turned around at the same nominal depth within the retarding field. As shown in FIG. 3, however, the energy spread $\forall\ U_o$ for ions of the same mass having a nominal energy eV results in ions having the same mass penetrating the reflector slightly more or less than the nominal depth of an ion of energy eV. Because ions having a higher energy (and velocity) penetrate deeper into the opposing field, they spend more time in the reflectron and will lag slower ions having the same mass upon exiting the reflectron. However, the lagging ions exit the reflectron at a higher velocity and thus catch up with the slower ions. Thus, instead of continuing to disperse through the drift region (as in the linear TOF mass spectrometer), the reflectron imparts a focusing effect on the ions traveling in the drift region.

For the reflectron configuration of FIG. 3, the time of flight is given by:

$$t=(m/2eV)\exp(-1/2)[L_1+L_2+4d]$$

The voltage placed on the last lens element $V_r$ is generally slightly larger than the accelerating voltage V, so that the average penetration depth d will be slightly shorter than the reflectron depth. A first-order kinetic energy focusing at detector 164 positioned as shown for ions having the same mass is achieved when $L_1+L_2=4d$. In addition, for the reflectron having the voltage distribution as shown in FIG. 2*a*, such focusing occurs over the entire mass range for a detector located at one position in the focal region. Further details of such a nonlinear reflectron TOF mass spectrometer is described in U.S. Pat. No. 5,464,985 to Cornish et al., entitled "Non-linear Field Reflectron", issued Nov. 7, 1995, the contents of which are hereby incorporated by reference.

As noted above, a processor 166 receives the output of the detector 164, thus providing the mass spectral data. As noted above, processor 166 may process the mass spectral data to determine whether a selected compound of interest is present, or it may provide the mass spectral data to a separate processing device (such as a PC) for such processing. In addition, processor 166 may provide the optimal lasing parameters to laser 114 and also provides the timed pulsing signals to the laser 114 and pulsed valve 124, as described above. (Thus, processor 166 has an electrical or other interface with laser 114 and valve 124, which is not shown in FIG. 3 for convenience.)

Alternatively, the mass spectrometer within the housing 112 of FIG. 2 may be the Photo-Chem 110 with a Model SF-12 air sampler and a $CO_2$ pulsed laser, as described above with the pulsed valve being the Iota One valve (Model Number 99-46-900) from General Valve Corporation driven by the Iota One valve controller. Other types of mass spectrometers may also be used in the system.

In addition, the user may input other parameters that may be used to optimize the lasing parameters. For example, the user may input what type of substrate the compound of interest is located on or within. The substrate may be, for example, dirt, a porous surface, a non-porous surface, etc. The optimum lasing parameters for substances stored in the database may be further defined as function of substrate. The optimum lasing parameters based on substance may be determined empirically and stored in the database associated with the mass spectrometer system processor. For example, the optimum lasing wavelength, pulse-width, power, etc. may be greater for detecting RDX if it is in a soil sample where the laser must penetrate further in order to vaporize a sufficient sample than if it is in a dust form lying on a Formica table. Thus, when the user inputs the type of substrate (via the GUI, display, or other input device), the laser parameters used to vaporize the sample will take into account the substrate in which the suspected compound of interest resides.

In addition, the vaporization provided by the laser and the associated intake of the sample provided by the pulsed valve may be readily adapted to other vapor detectors, including optical spectrometers, ion mobility spectrometers and gas chromatographs.

Although illustrative embodiments of the present invention have been described herein with reference to the accompanying drawings, it is to be understood that the invention is not limited to those precise embodiments, but rather it is intended that the scope of the invention is as defined by the scope of the appended claims.

What is claimed is:

1. A mass spectrometer system comprising a pulsed laser and a mass spectrometer, the mass spectrometer having a vacuum interface comprising a pulsed valve that provides entrance of a gaseous sample into an extraction region of the mass spectrometer, the laser positioned to provide laser light incident on a sample non-gaseous substance positioned adjacent the pulsed valve, wherein the laser light provides vaporization of the sample, that provides a high concentration of gaseous molecules from the sample substance at the pulsed valve the opening of the pulsed valve being synchronized with a pulse of laser light from the laser.

2. The mass spectrometer system as in claim 1, wherein the synchronized opening of the pulsed valve is provided by a controller.

3. The mass spectrometer system as in claim 1, wherein at least one parameter of the laser light emitted by the laser is adjusted to provide enhanced vaporization of a compound of interest suspected of being included in the sample.

4. The mass spectrometer system as in claim 3, wherein the at least one parameter is one of the wavelength, power, pulse-width and pulse frequency.

5. The mass spectrometer system as in claim 3, wherein the compound of interest is selected by a user via an associated user interface.

6. The mass spectrometer system as in claim 5, wherein the system further includes an associated database of compounds and one or more associated parameters that provide enhanced vaporization of the respective compound, and an associated controller that receives the compound of interest selected by the user and initiates adjustment of the laser light in accordance with the one or more associated parameters as stored in the database for the selected compound.

7. The mass spectrometer system of claim 1, wherein the system is a field portable mass spectrometer system.

8. A method of analyzing a non-gaseous sample for a compound of interest, the method comprising the steps of:

a) generating laser light having at least one parameter adjusted to provide enhanced vaporization of the compound of interest from the sample;

b) directing the laser light so that it is incident on the sample for at least one time interval, thereby vaporizing at least part of the sample;

c) synchronizing a collection of at least a portion of the vapor with the at least one time interval including opening a pulsed valve at a time determined in relation to the at least one time interval; and d) performing a chemical vapor analysis of the portion of the vapor collected, the chemical vapor analysis including determining whether the substance of interest is present in the sample.

9. The method of claim 8, wherein the chemical vapor analysis is one of mass spectroscopy, optical spectroscopy, ion mobility spectroscopy and gas chromatography.

10. The method of claim 8, wherein the at least one parameter is one of wavelength, power, pulse-width and pulse frequency.

* * * * *